US005942144A

United States Patent [19]

Lee

[11] Patent Number: 5,942,144

[45] Date of Patent: Aug. 24, 1999

[54] DOOR FOR MICROWAVE OVEN

[75] Inventor: Suk-Hee Lee, Kyungki-Do, Rep. of Korea

[73] Assignee: Samsung Electronics Co., Ltd., Suwon, Rep. of Korea

[21] Appl. No.: 09/066,716

[22] Filed: Apr. 27, 1998

[30] Foreign Application Priority Data

Jun. 25, 1997 [KR] Rep. of Korea ..... 97-27313

[51] Int. Cl.[6] ..... H05B 6/76

[52] U.S. Cl. ..... 219/738; 219/739; 219/741; 219/743

[58] Field of Search ..... 219/738, 739, 219/740, 741, 742, 743

[56] References Cited

U.S. PATENT DOCUMENTS 4,794,218 12/1988 Nakano et al. ..... 219/742

5,705,797 1/1998 Seo ..... 219/742

5,789,724 8/1998 Lerssen et al. ..... 219/741

*Primary Examiner*—Tu Ba Hoang

*Attorney, Agent, or Firm*—Burns, Doane, Swecker & Mathis, L.L.P.

[57] ABSTRACT

A door of a microwave oven includes an outer cover defining an exterior of the door, a door frame coupled to the outer cover and forming a choke recess for preventing microwave leakage, and a bracket including two parallel walls surrounding the choke recess and fixing the door frame to the outer cover. One of the parallel walls of the bracket contacts a wall of the door frame forming a front surface of the choke recess so as to prevent the choke recess from being deformed when the door is being assembled.

3 Claims, 5 Drawing Sheets

DOOR FOR MICROWAVE OVEN

BACKGROUND OF THE INVENTION (1) Field of the Invention

The present invention relates to a microwave oven and, more particularly, to a microwave oven having a door which forms a choke recess for the prevention of microwave leakage.

(2) Description of the Prior Art

Generally, a microwave oven is a cooking appliance which cooks food by frictional heat generated by making the molecules of the food being cooked move at high speeds with the use of microwaves.

Referring to FIG. 1, shown is a perspective view of a conventional microwave oven. As shown in drawing, the conventional microwave oven comprises a main body 10 defining an exterior of the microwave oven, a cooking chamber 20 having predetermined dimensions and inside of which food to be cooked is placed, and an electrical component compartment 30 provided to one side of the cooking chamber 20. Provided on a front of the microwave oven are a door 40 for opening and closing the cooking chamber 20, the door 40 being attached by hinge members (not shown), and a control panel 22 which is manipulated by the user to make various selections for the cooking of food.

The electrical component compartment 30 includes a transformer 31 for raising a level of voltage supplied from an external electric power source, and a magnetron 32 for generating microwaves using the high voltage supplied from the transformer 31 and radiating the microwaves into the cooking chamber 20.

In such a microwave oven, as microwaves are harmful to the human body, the door 40 and main body 10 of the microwave oven should be designed to prevent the leakage of these damaging microwaves from the same. Particularly, it is preferable that the microwave oven has a built-in microwave leakage-prevention mechanism. There are various techniques for preventing the leakage of microwaves, the most common of which is a choke structure provided on the door 40 of the microwave oven.

In such a choke structure, a choke recess of a given shape is formed on a predetermined area of the main body 10 or door 40 of the microwave oven. The depth of the recess is preferably ¼ of a length of a microwave to offset the same. Such a structure acts to make an impedance at an open end of the recess infinite in magnitude, thereby restricting the leakage of microwaves.

The above choke structure will be described hereinafter with reference to FIGS. 2 and 3, which show respectively an exploded perspective view of the door of FIG. 1, and a cross sectional view taken along line III—III of FIG. 2.

The door 40 for opening and closing the cooking chamber 20 comprises an outer cover 41 having a window 41*a* through which food in the cooking chamber 20 can be viewed by the user, a door frame 42 having a screen 42*a* provided in a center portion thereof, and a bracket 43 for fixedly connecting the door frame 42 to the outer cover 41.

As shown in FIG. 3, an outer peripheral end of the door frame 42 is bent in such a manner to form a choke recess 44 for preventing the leakage of microwaves. Further, inner and outer peripheral ends 43*a* and 43*b* of the bracket 43 protrude toward the outer cover 41 to surround the recess 44. That is, the inner peripheral end 43*a* of the bracket 43 is inserted inside the recess 44 through an opening of the same, and the outer peripheral end 43*b* is fixedly inserted between the outer cover 41 and the door frame 42.

However, when assembling the door in the conventional microwave oven structured as described above, the shape of the end 42*b* of the door frame forming a rear side of the choke recess may become deformed by the force used in mounting the bracket 43 to the door frame and outer cover. As a result, the choke recess loses its ability to prevent the leakage of microwaves.

Further, because of the lack of such a supporting member for the bracket, it is possible for the door frame to become deformed if the bracket receives outside shock, resulting in the same problem of microwave leakage.

SUMMARY OF THE INVENTION

The present invention has been made in an effort to solve the above described problems.

It is an object of the present invention to provide a microwave oven having a door forming a reinforced choke recess which resists being deformed during a door assembly process such that the effectiveness of the choke recess (i.e., prevention of microwave leakage) can be fully realized.

According to the present invention, there is provided a microwave oven having a main body forming a cooking chamber, and a door mounted on the main body for opening and closing the cooking chamber. The door includes an outer cover defining an exterior of the door, a door frame coupled to the outer cover and forming a choke recess for preventing microwave leakage, and a bracket including peripheral ends protruded for surrounding the choke recess and fixing the door frame to the outer cover securely. One of the peripheral ends of the bracket is formed to contact an inner surface of the choke recess so as to prevent the choke recess from being deformed when assembling the door.

More particularly, the cover of the door includes a front section having an outer periphery. The outer periphery includes a first wall extending rearwardly toward the main body when the door is closed, whereby the front section and the first wall form a cavity which opens toward the main body. The frame is disposed in the cavity and includes a rear section having an outer periphery. The rear section is spaced rearwardly from the front section. The outer periphery of the rear section of the frame includes a second wall extending forwardly from the rear section, a third wall extending perpendicularly outwardly from a front end of the second wall in a direction toward the first wall, a fourth wall extending rearwardly from an outer end of the third wall, the fourth wall being spaced inwardly from the first wall and oriented parallel thereto, and a fifth wall extending perpendicularly inwardly from a rear end of the fourth wall in a direction away from the first wall. An end of the fifth wall forms a space with the second wall. The second, third, fourth and fifth walls form a choke recess for resisting microwave leakage. The bracket includes a rear portion having an outer periphery. The rear portion extends rearwardly of and parallel to the fifth wall. The outer periphery of the rear section of the bracket includes a sixth wall projecting forwardly from the rear section of the bracket between the first and fourth walls, and a seventh wall projecting forwardly from the rear section of the bracket and passing through the space formed between the second and fifth walls. The seventh wall extends parallel to the second wall and contacts a rearwardly facing surface of the third wall for preventing the choke recess from being deformed when the door is assembled.

BRIEF DESCRIPTION OF THE DRAWINGS

The above object, and other features and advantages of the present invention will become more apparent by describing preferred embodiments thereof in detail with reference to the attached drawings, in which.

DETAILED DESCRIPTION OF A PREFERRED EMBODIMENT OF THE INVENTION

Figure 1:
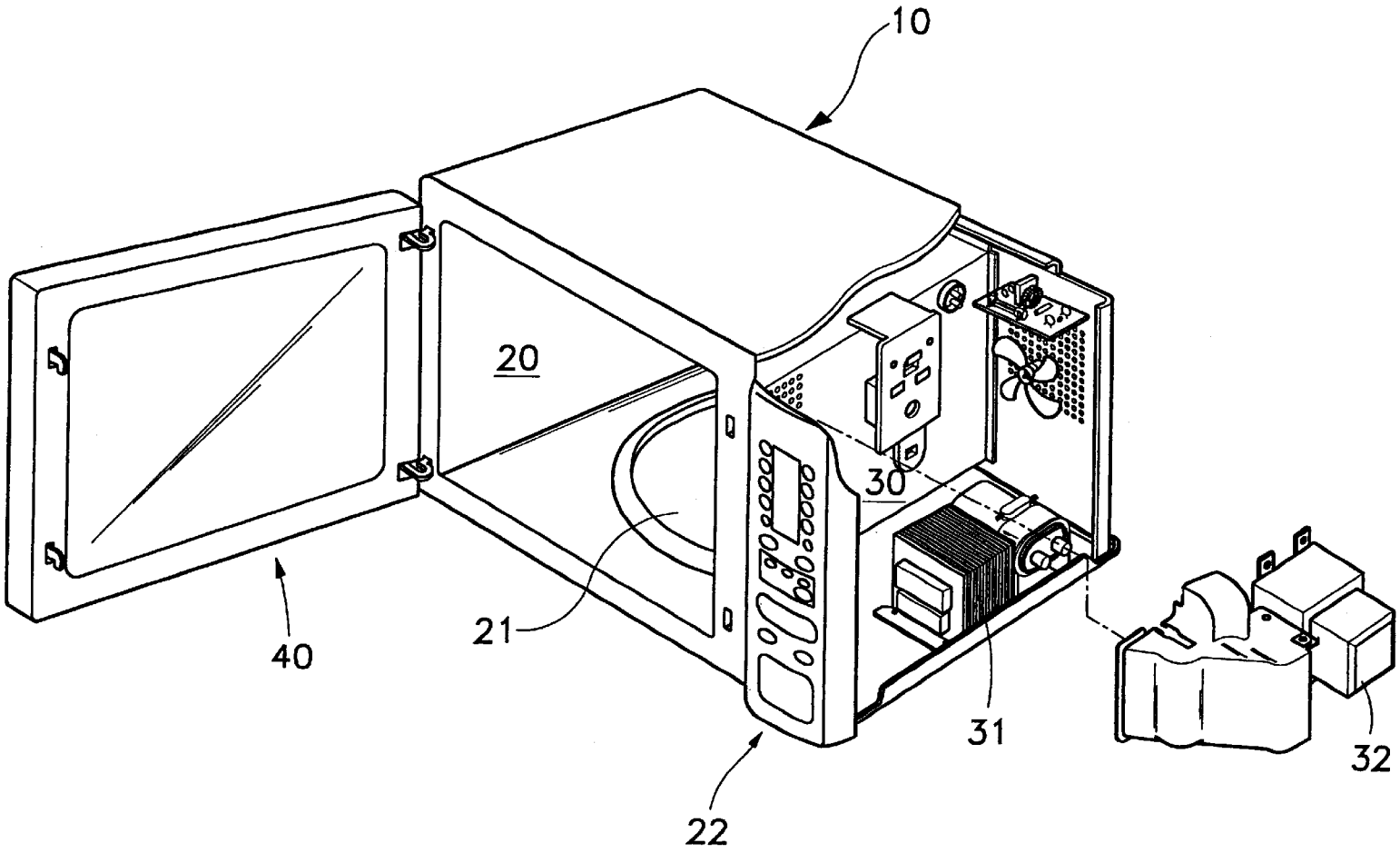
FIG. 1 (PRIOR ART)
FIG. 1 is a perspective view of a conventional microwave oven.
Figure 2:
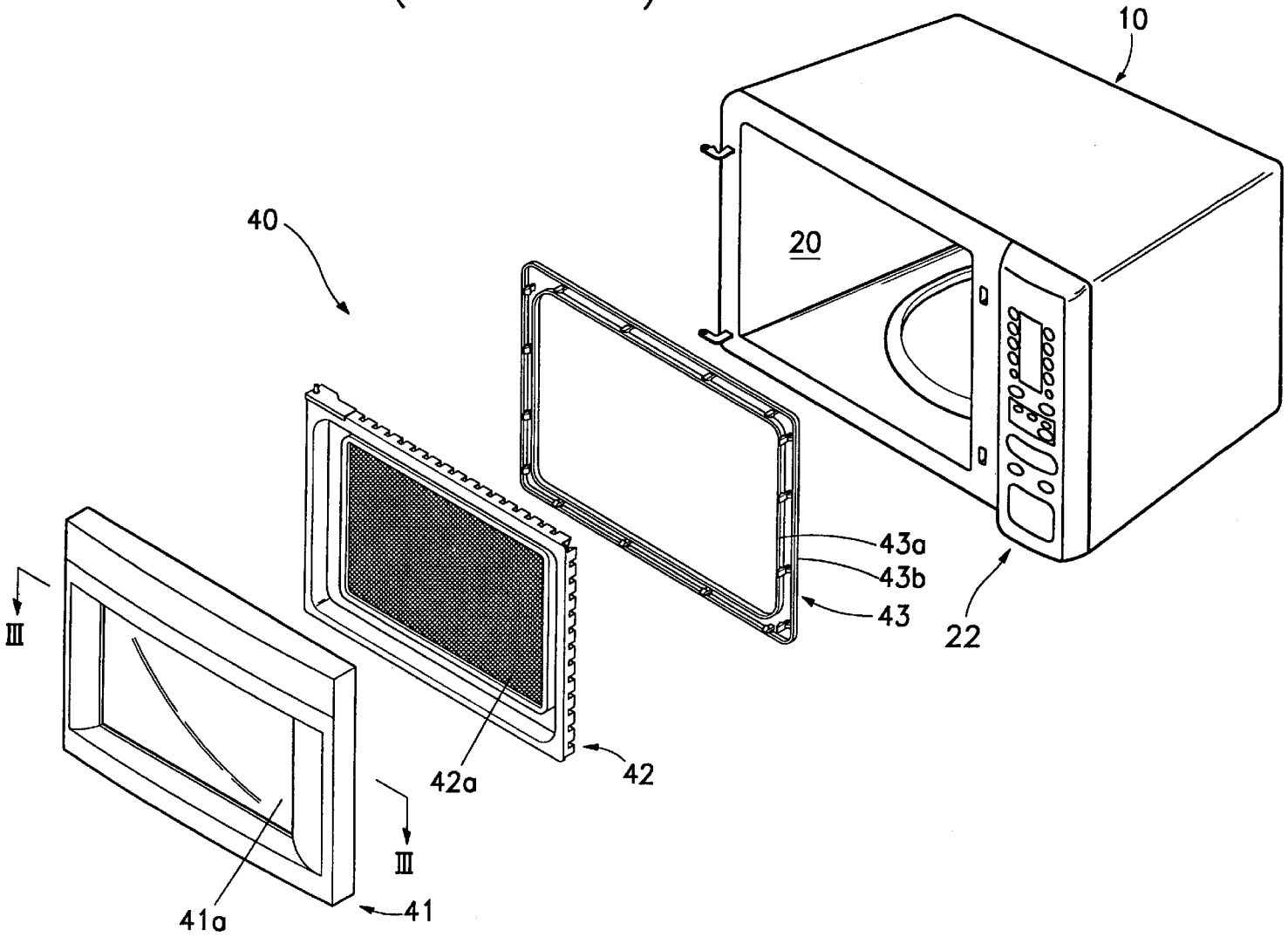
FIG. 2 (PRIOR ART)
FIG. 2 is an exploded perspective view illustrating a door of FIG. 1.
Figure 3:
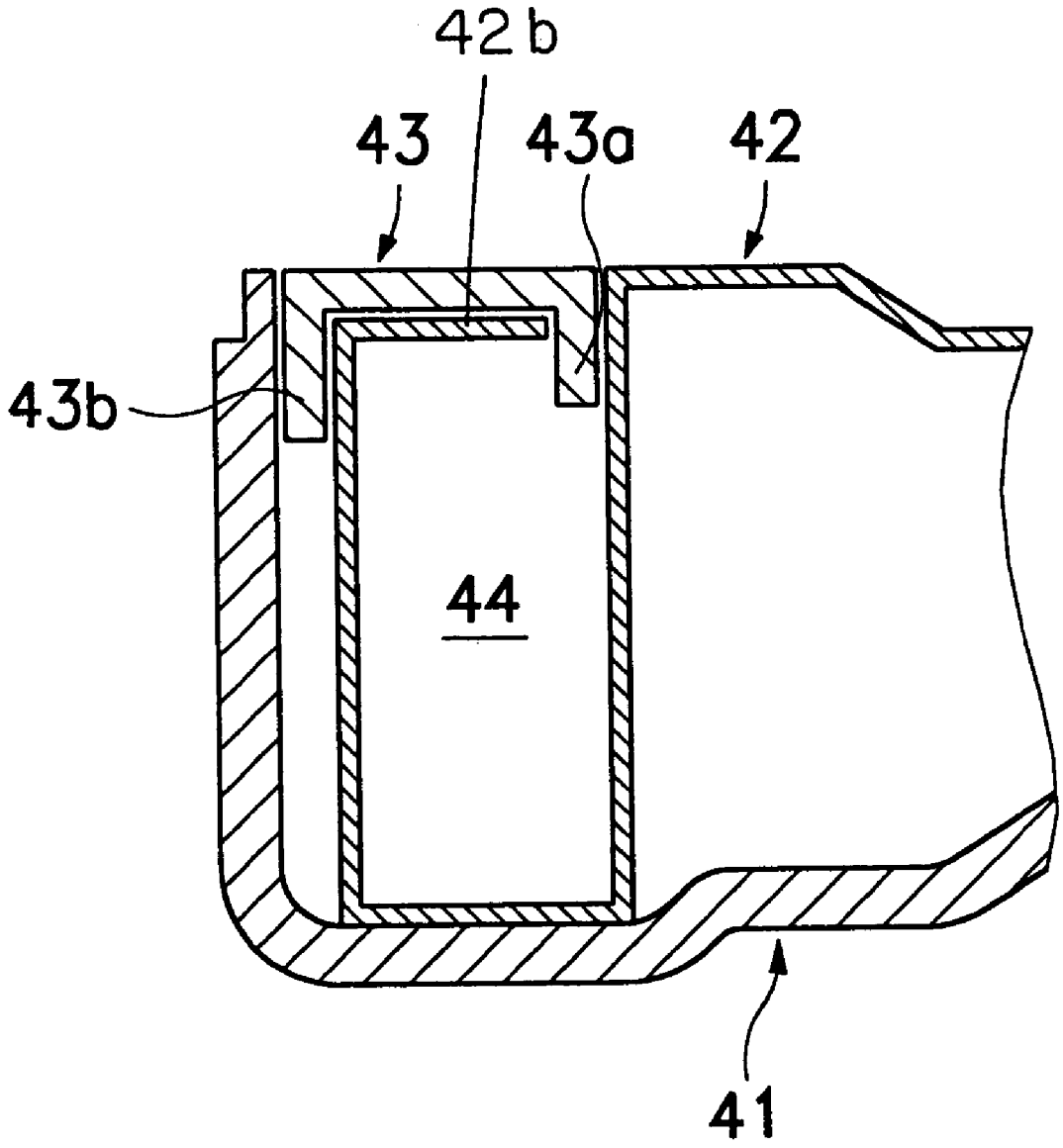
FIG. 3 (PRIOR ART)
FIG. 3 is a cross sectional view taken along line III—III of FIG. 2.

A preferred embodiment of the present invention will now be described in detail with reference to the accompanying drawings.

As the main elements of the microwave oven according to the present invention are identical to that of the conventional microwave oven, the same reference numerals will be used and an explanation thereof will be omitted.

Figure 4:
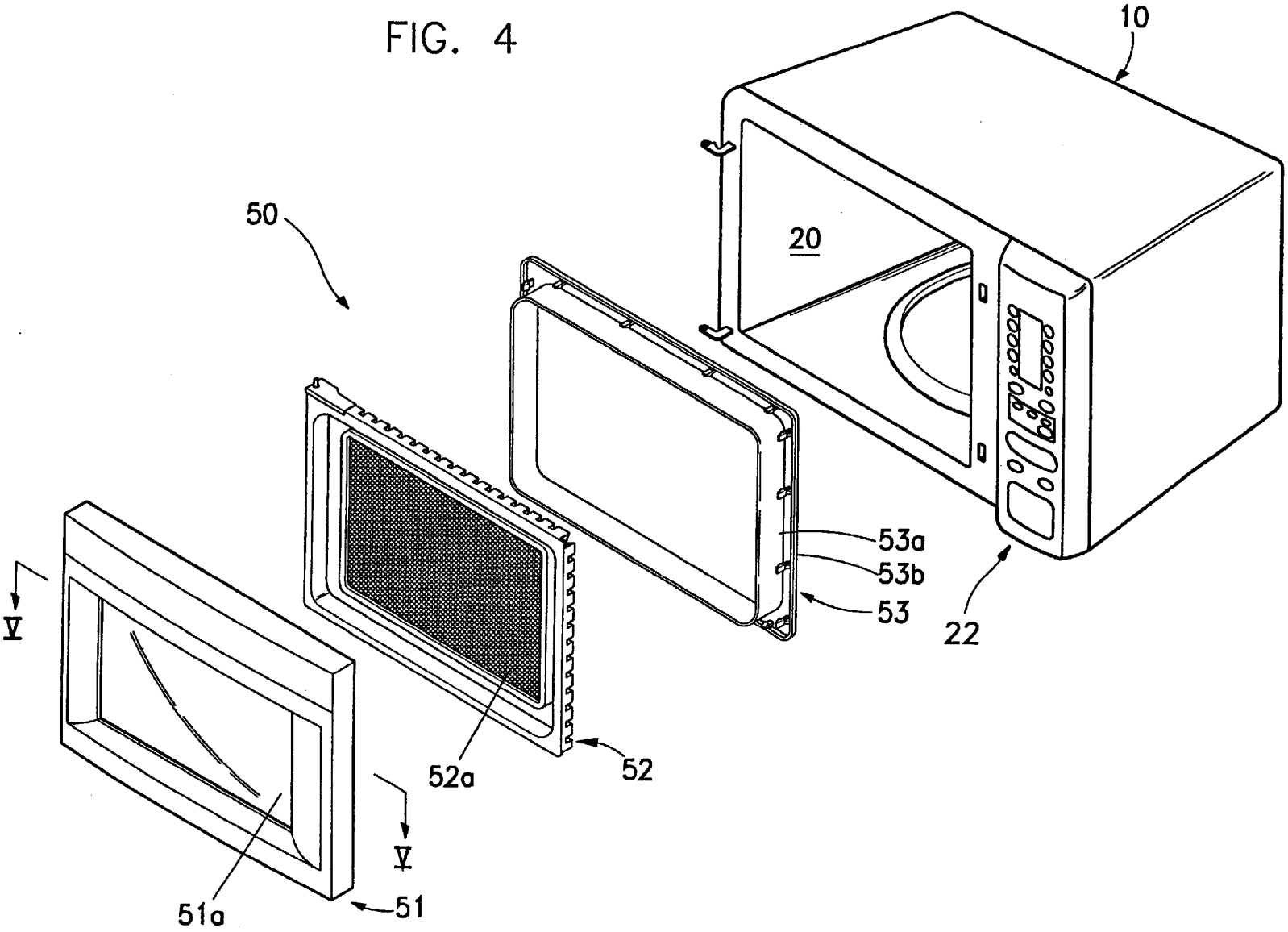
FIG. 4 is an exploded perspective view illustrating a door of a microwave oven according to the present invention.
Figure 5:
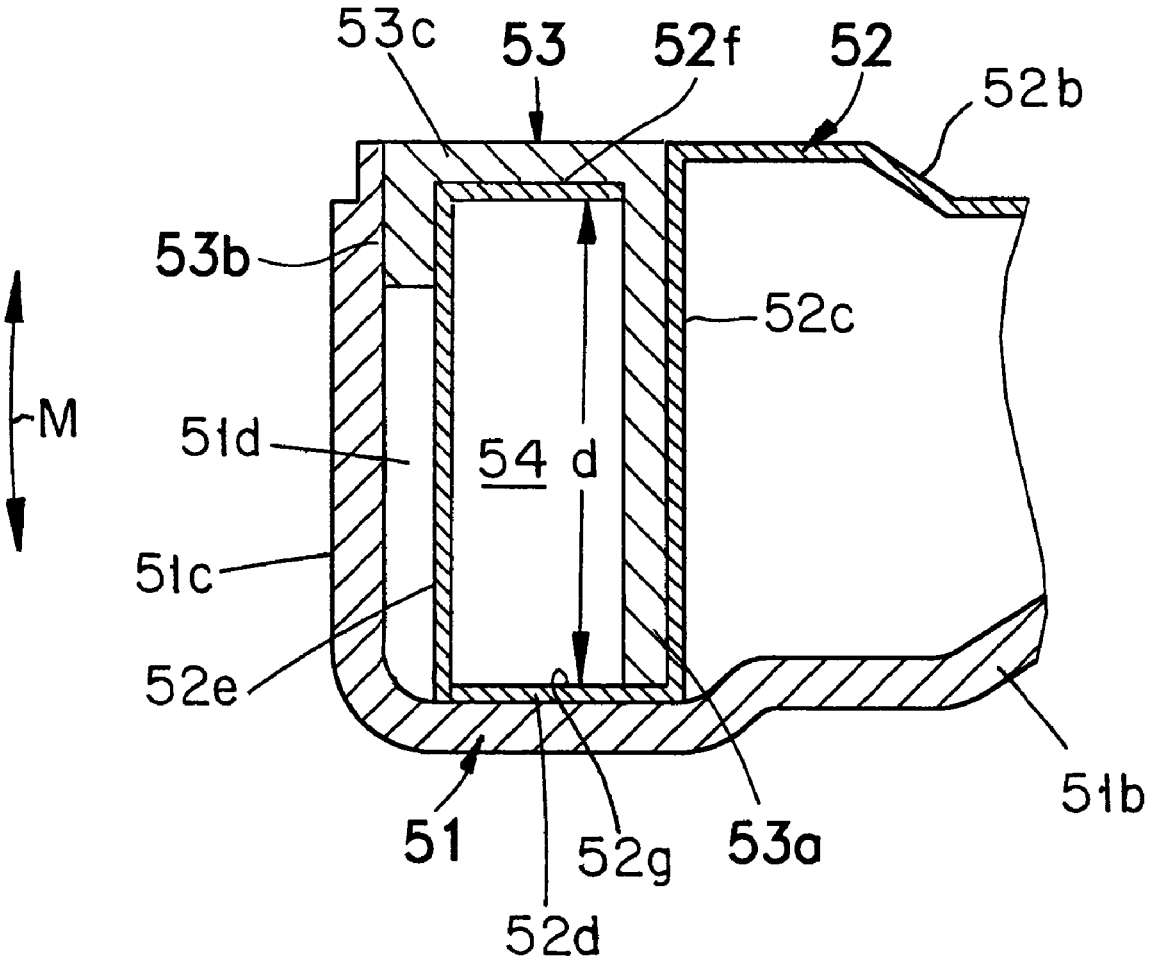
FIG. 5 is a cross sectional view taken along line V—V of FIG. 4.

Referring to FIGS. 4 and 5, shown respectively are an exploded perspective view of a door of a microwave oven according to the present invention, and a cross sectional view taken along the line V—V of FIG. 4.

As shown in drawings, the inventive microwave oven comprises a main body 10 defining an exterior of the microwave oven, a cooking chamber 20 formed having predetermined dimensions and inside of which food to be cooked is placed, and an electrical component compartment (not shown) provided to one side of the cooking chamber 20. The cooking chamber is open in a forward direction. Provided on a front of the microwave oven are a door 50 for opening and closing the cooking chamber 20, the door 50 being attached by hinge members (not shown), and a control panel 22 which is manipulated by the user to make various selections for the cooking of food.

The door 50 comprises an outer cover 51 defining an exterior of the door 50 and having a window 51*a* through which food in the cooking chamber 20 can be viewed by the user; a door frame 52 having a screen 52*a* provided in a center portion thereof, the screen 52*a* being made of a metal sheet having a plurality of fine holes; and a bracket 53 for fixedly connecting the door frame 52 to the outer cover 51, inner and outer peripheral walls 53*a* and 53*b* of the bracket 53 protruding forwardly toward the door frame 52.

As shown in FIG. 5, an outer peripheral end of the door frame 52 is bent in such a manner to form a choke recess 54 for preventing the leakage of microwaves, and a rear end 52*f* of the door frame 52 extends to cover roughly ¾ of a rear side of the recess 54. The recess defines a depth d extending generally in a direction of movement M of the door.

In addition, the bracket 53 for fixing the door frame 52 to the outer cover 51 securely surrounds the recess 54. The inner peripheral wall 53*a* of the bracket 53 is inserted inside the recess 54 past the end 52*f* of the door frame 52, and the outer peripheral wall 53*b* is inserted fixedly between the outer cover 51 and the door frame 52.

In accordance with the present invention, the inner peripheral wall 53*a* of the bracket 53 is dimensioned to contact a rearwardly facing inner surface 52*g* of the recess 54 when assembling the door 50, thereby preventing the end 52*f* of the door frame 52 from being deformed by forces applied for assembling the bracket 53 to the door frame 52. That is, even if an excessive amount of force is applied to the bracket 53 when assembling the bracket to the door frame 52, since the bracket 53 is supported by the contact of the inner peripheral end 53*a* with the inner surface 52*g* of the recess 54, the end 52*f* of the door frame 52 defining a rear side of the recess 54 is not affected by the force used during assembly, thus preventing the recess 54 from being deformed.

More particularly, the cover 51 includes a front section 51*b* having an outer periphery. The outer periphery includes a first wall 51*c* extending rearwardly toward the main body when the door is closed, whereby the front section 51*b* and the first wall 51*c* form a cavity 51*d* opening rearwardly toward the main body.

The frame 52 is disposed in the cavity 51*d*. The frame includes a rear section 52*b* having an outer periphery. The rear section 52*b* is spaced rearwardly from the front section 51*b*. The outer periphery of the rear section 52*b* includes a second wall 52*c*, a third wall 52*d*, a fourth wall 52*e*, and a fifth wall 52*f*. The second wall 52*c* extends forwardly from the rear section 52*b*. The third wall 52*d* extends perpendicularly outwardly from a front end of the second wall 52*c* in a direction toward the first wall 51*c*. The fourth wall 52*e* extends rearwardly from an outer end of the third wall 52*d* and is spaced inwardly from the first wall 51*c* and oriented parallel thereto. The fifth wall 52*f* extends perpendicularly inwardly from a rear end of the fourth wall 52*e* in a direction away from the first wall 51*c*. An end of the fifth wall 52*f* terminates short of the second wall 52*c*, thereby forming a space therewith. The second, third, fourth, and fifth walls form a choke recess 54 for resisting microwave leakage.

The bracket 53 includes a rear section 53*c* having an outer periphery. That rear section 53*c* is disposed rearwardly of and extends parallel to the fifth wall 52*f*. The outer periphery of the rear section 53*c* includes a sixth wall defined by the wall 53*b*. The sixth wall projects forwardly between the first and fourth walls 51*c* and 52*e*. The bracket further includes a seventh wall defined by the wall 53*a*. The seventh wall projects forwardly farther than the wall 53*b* and passes through the space formed between the second and the fifth walls 52*c* and 52*f*. The seventh wall 53*a* extends parallel to the second wall 52*c* for the entire depth d of the recess and contacts the rearwardly facing surface 52*g* of the third wall 52*d* for preventing the fifth wall 52*f* from being deformed when the door is assembled, whereby the choke recess 54 retains its shape.

As described above, in the microwave oven according to a preferred embodiment of the present invention, the door is structured such that the choke recess does not become deformed during the assembly of the door. Accordingly, the capability of the choke recess to prevent microwave leakage is able to be fully realized.

While the invention has been described in connection with what is presently considered to be most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A microwave oven having a main body forming a cooking chamber, and a door mounted on said main body for movement in a direction for opening and closing the cooking chamber, said door including an outer cover defining an exterior of the door, a door frame coupled to the outer cover and forming a choke recess for preventing microwave leakage, and a bracket including a pair of walls surrounding the choke recess and fixing the door frame to the outer cover securely, the choke recess defining a depth extending generally in the direction of movement of the door, one of the walls of the bracket extending the full depth of the recess and contacting a wall of the door frame which forms a front surface of the choke recess so as to prevent the choke recess from being deformed when assembling the door.

2. A microwave oven having a main body forming a cooking chamber which is open in a forward direction, and a door mounted on said main body for opening and closing said cooking chamber, said door comprising:

a cover defining an exterior of said door, said cover including a front section having an outer periphery, said outer periphery including a first wall extending rearwardly toward said main body when said door is closed, whereby said front section and the first wall form a cavity opening rearwardly toward said main body;

a frame coupled to said cover and disposed in said cavity, said frame including a rear section having an outer periphery, said rear section spaced rearwardly from said front section, said outer periphery of said rear section of said frame including:

a forwardly extending second wall, a third wall extending perpendicularly outwardly from a front end of said second wall in a direction toward said first wall, a fourth wall extending rearwardly from an outer end of said third wall, said fourth wall being spaced inwardly from said first wall and oriented parallel thereto, and a fifth wall extending perpendicularly inwardly from a rear end of said fourth wall in a direction away from said first wall, an end of said fifth wall forming a space with said second wall, said second, third, fourth and fifth walls forming a choke recess for resisting microwave leakage; and a bracket connected to said cover and said frame, said bracket including a rear section having an outer periphery, said rear section disposed rearwardly of and extending parallel to said fifth wall, said outer periphery of said rear section of the bracket including:

a sixth wall projecting forwardly between said first and fourth walls, and a seventh wall projecting forwardly and passing through said space formed between said second and fifth walls, said seventh wall extending parallel to said second wall and contacting a rearwardly facing surface of said third wall for preventing said choke recess from being deformed when the door is being assembled.

3. The microwave oven according to claim 2 wherein said seventh wall extends forwardly farther than said sixth wall.

* * * * *